United States Patent [19]

Mehlan et al.

[11] 4,396,105

[45] Aug. 2, 1983

[54] PRICE SETTING MECHANISM FOR A VENDING MACHINE

[75] Inventors: Bernd Mehlan, Herrieden; Josef Gress, Bechhofen, both of Fed. Rep. of Germany

[73] Assignee: Sielaff GmbH & Co., Automatenbau Herrieden, Fed. Rep. of Germany

[21] Appl. No.: 306,427

[22] Filed: Sep. 28, 1981

[30] Foreign Application Priority Data

Oct. 30, 1980 [DE] Fed. Rep. of Germany ..... 3040938

[51] Int. Cl.[3] ..... G07F 5/08

[52] U.S. Cl. ..... 194/1 L; 221/124

[58] Field of Search ..... 194/DIG. 4, 2, 1 G, 194/DIG. 3, 1 L; 221/123, 124, 125

[56] References Cited

U.S. PATENT DOCUMENTS 4,323,147 4/1982 Kolbl et al. ..... 194/1 L

*Primary Examiner*—Stanley H. Tollberg

*Attorney, Agent, or Firm*—McGlew and Tuttle

[57] ABSTRACT

A price setting mechanism of a vending machine for setting one of two or more sales prices is disclosed. Merchandise dispensing devices are mounted on an operating base plate. Depending on the sales price, at least one control bar is coupled to a respective merchandise dispensing device, on the one hand, and to a release mechanism for the merchandise dispensing device on the other. To make the setting mechanism simple and clearly settable, there are fastened to the control bar or bars, guide bushings which extend transverse to the travel direction of the control bars and in which slide pins are mounted. In one position, one end of each slide pin projects into the path of motion of a control cam of the merchandise dispensing device while being outside of the path of motion of the control cam in a second position thereof. The other end of the slide pins project beyond this bushing in each one of the two positions, on the operating base plate side which is opposite the merchandise dispensing devices.

5 Claims, 6 Drawing Figures

III
13
9
16
10
40
2
11,12
13
16
2
9
1
10
III

III
1
21
1
3
22
11,12
7
8
21
4
22
37
5
36
6
31
38
41
29
39
32
34,35
30
33'
V
40
33
III

PRICE SETTING MECHANISM FOR A VENDING MACHINE

FIELD AND BACKGROUND OF THE INVENTION

The present invention relates in general to vending machines and in particular to a new and useful setting mechanism for a vending machine, to set one or two or more sales prices for merchandise dispensing devices which are mounted to an operating base plate and along which extends at least one control bar coupled to the one hand, depending on the sales price, to the respective merchandise dispensing devices by means of coupling members, and on the other hand to a release mechanism for the merchandise dispensing devices.

Additional information can be found in two related co-pending applications entitled MECHANICAL VENDING MACHINE and TRAP DOOR CHUTE FOR VENDING MACHINES, which are incorporated here by reference.

Such a setting mechanism is mentioned in German Offenlegungsschrift No. 26 44 016. Therein, two shiftable control bars are provided. Tapped holes are provided on slide carriers of the merchandise dispensing devices, into which screws can be screwed so that each merchandise dispensing device is coupled selectively either to the one and/or to the other control bar.

Such a mechanism is also described in German Gebrauchsmuster No. 79 09 711. Here, the control bars are rotatable shafts. They act upon a crediting unit via a lever system.

Coupling the control bar to the merchandise dispensing devices by means of threaded pins is cumbersome in operation because the threaded pins are located in a hidden place. This particularly felt when the once selected coordination of a sales price with a merchandise dispensing device is to be changed.

SUMMARY OF THE INVENTION

It is an object of this invention to propose a mechanism of the kind described at the outset, which is simple to operate and easy to switch, and the respective setting of which is clearly recognizable.

According to the invention, the above problem is solved in that guide bushings in which sliding pins are mounted are fastened to the control bar or bars, extending transverse to its or their travel direction. One end of each sliding pin projects, in one position, into the path of motion of a merchandise dispensing device control cam while being outside of the path of motion of the control cam in a second position thereof. The other end of the slide pin projects beyond the bushing on the operating base plate side opposite the merchandise dispensing devices in each one of the two positions.

What this achieves, is that the sliding pins are disposed so as to be clearly visible on the operating base plate and that they permit the sales price coordination with the various merchandise dispensing devices to be recognized. For switching, all that is needed is to pull or push the pins.

Accordingly, another object of the invention is to provide a price setting mechanism for a vending machine, to set one of two or more sales prices for merchandise dispensing devices which are mounted on an operating base plate and along which extends at least one control bar coupled to one respective merchandise dispensing device by means of coupling members, and to a release mechanism for the merchandise dispensing devices, the price setting mechanism comprising a guide bushing connected to said at least one control bar which extends transversely to a travel direction of said control bar, a slide pin slidably mounted in said bushing, and pin hold means for holding said pin in one of two positions, one position with an end of said pin projecting into the path of motion of a control cam of the merchandise dispensing device and the other position with said end outside the path of motion of the control cam, another end of said slide pin projecting beyond said bushing in each one of said two positions on an opposite side of said base plate, opposite the merchandise dispensing devices.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
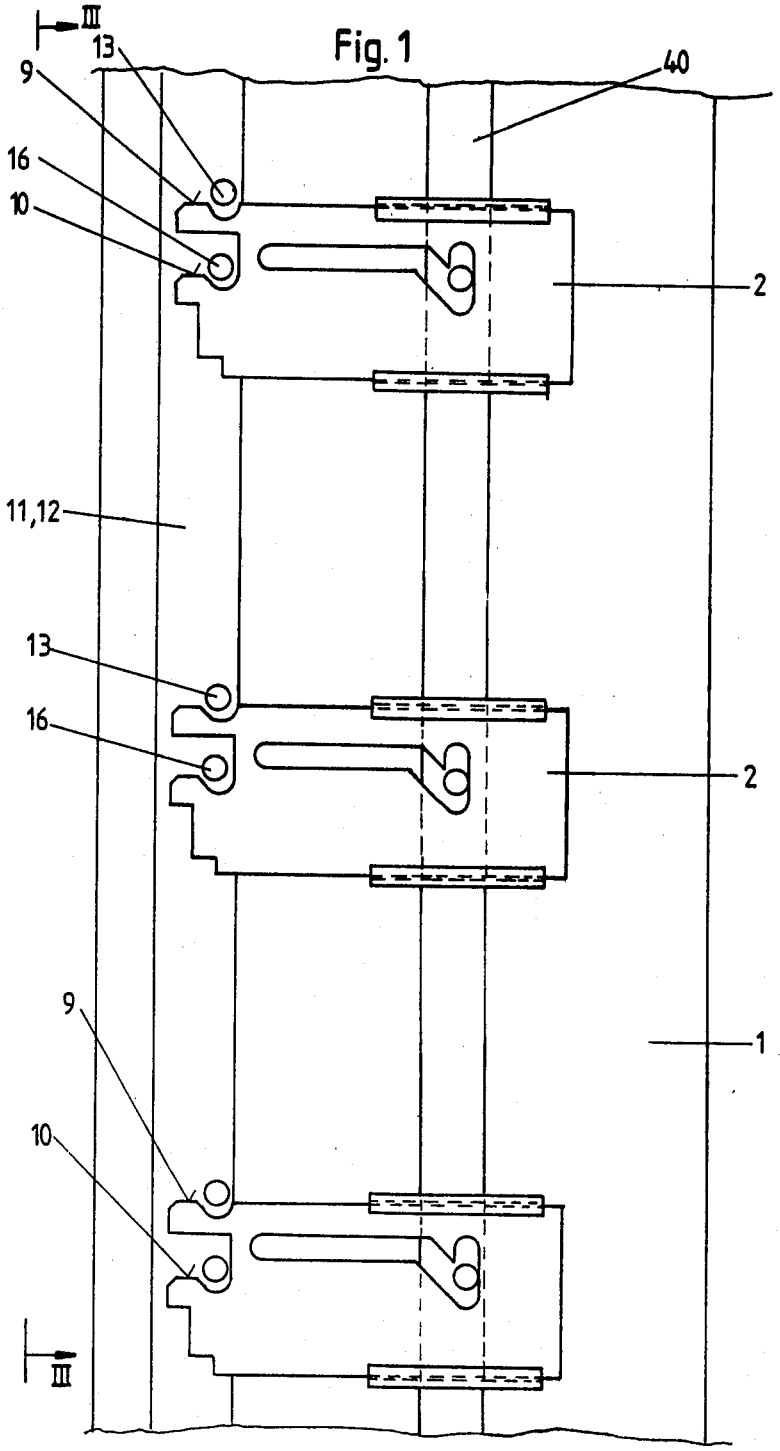
FIG. 1 is a left side elevational view of a vending mechanism seen from the merchandise dispensing device side, of the invention.

In the vending machine of the embodiment example, the merchandise dispensing compartments are arranged one on top of the other such as is the case of bottle or can automats. An operating base plate 1 of the vending machine, to which slide plates 2 are mounted, which slide plates are fastened to merchandise dispensing doors, stands upright in the vending machine.

A coin mechanism (see FIG. 2) comprising a coin checker 3, a crediting unit 4, a collector 5 and a release mechanism 6, is mounted to an opposite side of the operating base plate 1 from the slide plates 2.

The operating base plate 1 in this embodiment, is disposed vertically between a backwall 7 and a front door 8 of the vending machine. Such a machine can be used to dispense bottles or cans.

Each one of the slide plates 2 is acted upon by a dispensing door, not shown. Each slide plate 2 has, at its end facing the backwall 7, two control cams 9 and 10. Near the control cams 9 and 10 extend two control bars 11 and 12 which are movably mounted to the operating base plate 1, transversely to the slide plates 2.

A bushing 13 is fastened to the control bar 11 at the upper control cam 9 of each slide plate 2. The control bar 12 and the operating base plate 1 have cutouts 14, 15, respectively, through which the bushing 13 projects freely.

A bushing 16 is fastened to the control bar 12 at the lower control cam 10 of each slide plate 2. It projects freely through a cutout 17 in the operating base plate 1. The control bar 11 has a cutout 18 in the area of the bushing 16 of the control bar 12.

Figure 3:
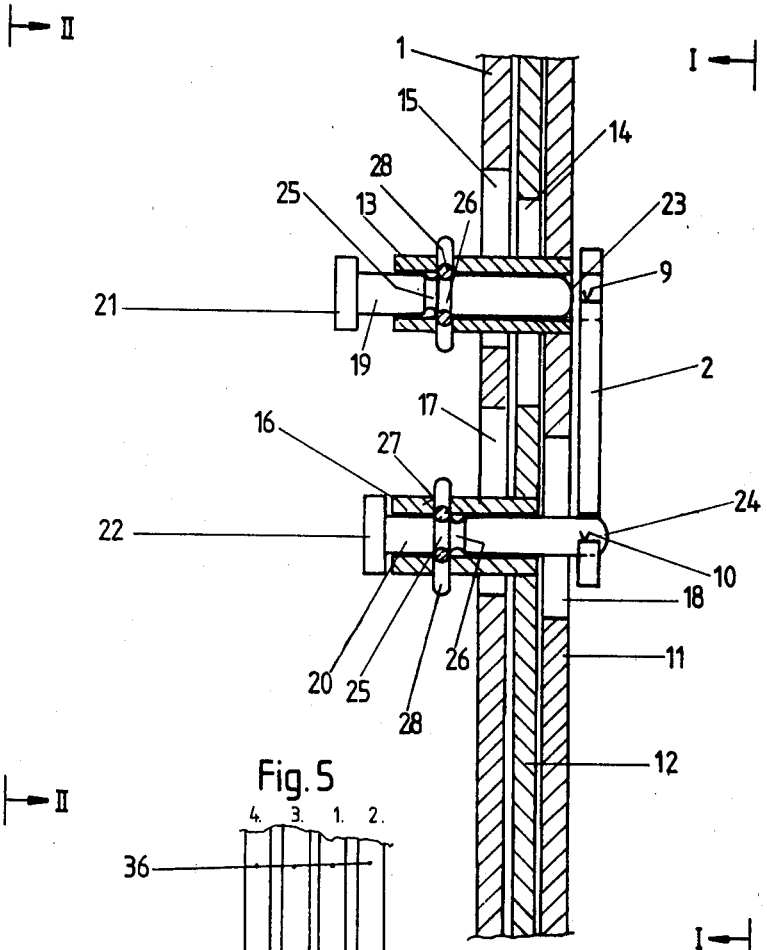
FIG. 3 is a partially sectional rear view of the mechanism taken along line III—III of FIGS. 1 and 2.

Slide pins 19 and 20 are mounted in the bushings 13 and 16. Their one end has a head 21 and 22, respectively. Their other ends 23 and 24 are designed to contact the control cams 9 and 10. In FIG. 3 the slide pin 19 is shown in pulled position in which it is not in contact with the associated control cam 9. The slide pin 20 is shown in pushed position in which it is in contact with the associated control cam 10.

Figure 4:
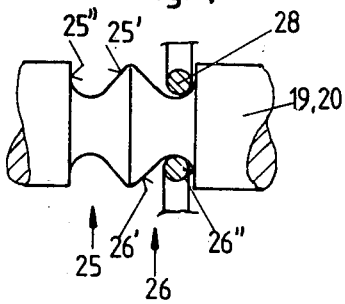
FIG. 4 is a fragmentary view of a sliding pin in larger scale than FIG. 3.

To lock the slide pins 19, 20 in their two positions they have fillets 25 and 26. The bushings 13 and 16 have mutually opposite slots 27 through which a hair pin spring 28 engages the respective slide pin 19 or 20. Pin hold means are thus formed. The fillets 25 and 26 join each other in straight bevels 25′ and 26′ (FIG. 4), whereas opposite the bevels 25′ and 26′ they are designed as steep stop edges 25″ and 26″. This results in a detent profile which prevents intermediate positions, bridging the complete pulling out of the slide pins 19, 20. Therefore, if slide plate 2 is pulled forwardly (to the right in FIG. 1) and pin 20 is in its pushed position, bar 12 will be raised.

Figure 2:
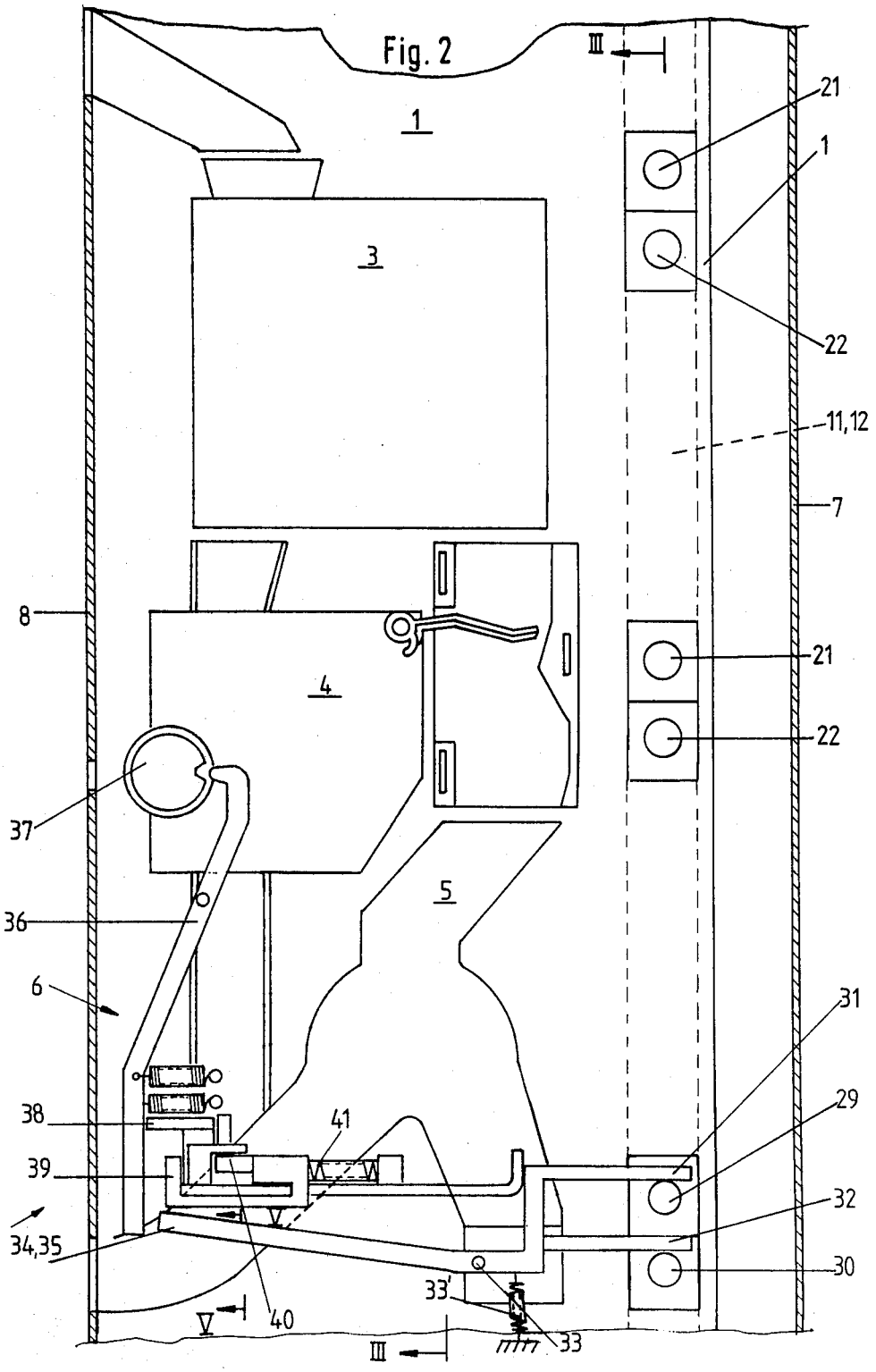
FIG. 2 is a right side elevational view of the coin mechanism of the vending machine on the side opposite the merchandise dispensing devices.

Below the collector 5 there are fastened, to the control bar, a pin 29 and to the control bar 12 is a pin 30 in bushings identical to the bushings 13 and 16. Resting on the pins 29, 30 are the free ends of dual-armed levers 31 and 32 which can pivot about a shaft 33 and are preloaded by extension springs 33′. The other free ends 34 and 35 are opposite scanning levers 36 whose other ends are coordinated with cam plates 37 of the crediting unit 4. A locking pawl 38 keeps the scanning levers 36 away from the cam plates 37 as long as no merchandise dispensing devices are actuated, that is, no slide plates 2 are moved. The scanning levers 36 singly can move a slide lock 39 out of the path of motion of a locking bar 40 which is connected to all slide plates 2 in the usual manner. FIG. 2 shows the slide lock 39 in its locking position in which it is held by a compression spring 41.

Figure 6:
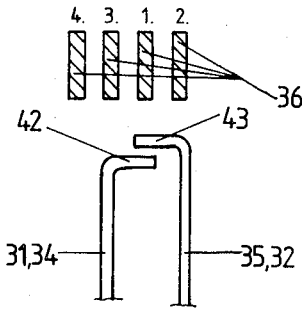
FIG. 6 is a fragmentary sectional view along line VI—VI in FIG. 5.

The ends 34, 35 of the levers 31, 32 have bends 42, 43 (FIG. 6). They overlap and both project into the path of motion of the same scanning lever.

Figure 5:
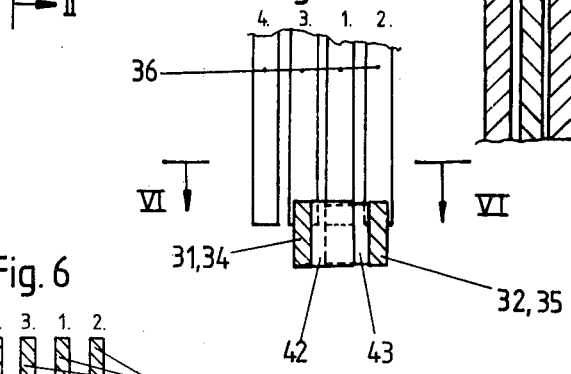
FIG. 5 is a fragmentary sectional view along line V—V of FIG. 2.

The operating mode of the described mechanism is roughly as follows:

The two control bars 11 and 12 can be coupled to the slide plate 2 of each one of the merchandise dispensing devices via the slide pins 19 and 20 in such a manner that, upon an actuation of the merchandise dispensing device, either one or the other control bar 11, 12 or both control bars 11, 12 or none of the control bars is shifted. In accordance therewith, either one of the levers 31, 32, or both levers 31, 32 or none of the levers is (are) pivoted by means of the pins 20, 30. In accordance with these four possibilities, each one of the merchandise dispensing devices can be set to one of four sales prices. Four cam plates 37 and four scanning levers 36 are then provided for this purpose, no control lever being coordinated with the fourth scanning lever and the bends 42 and 43 both being coordinated with the first scanning lever (number 1 in FIG. 5 and 6). Bend 42 can engage levers numbered 3 and 1, and bend 43 can engage levers numbered 1 and 2.

When the actuation of a merchandise dispensing device whose associated slide pins 19, 20 are both pulled is started, none of the control bars 11, 12 will move. The pawl 38 is always pulled back upon an actuation of one of the merchandise dispensing devices. Only the fourth scanning lever 36, assigned to the cam plate 37 set to the fourth and highest sales price can move the slide lock 39 and thus release the respective merchandise dispensing device, if the cam of this cam plate 37 is opposite the respective scanning lever 36, i.e., if the required amount in coins is in the collector 5. The first, second and third scanning levers (numbered 1, 2 and 3) are blocked so that they cannot move the slide lock 39 in the release direction, even though their cam of their respective cam plate is opposite them. Accordingly, after a coin insertion not corresponding to the highest sales price, a merchandise dispensing device cannot be opened.

When the actuation of a merchandise dispensing device is started whose slide pin 19 is pulled and whose slide pin 20 is pushed (see FIG. 3), the control bar 11 will move. This causes the lever 31 to pivot so that its free end 34 moves out of the path of motion of the third scanning lever 36 (lever 31 rotates counter clockwise in FIG. 2). The third lever 36 can then move the slide lock 39 in release direction also, provided the amount in coins corresponding to the third, next lower sales price reaches the collector 5 and is accounted for by the crediting unit 4. The first and second scanning levers are blocked by the lever 32 or its bend 43.

When the actuation of a merchandise dispensing device is started whose slide pin 19 is pushed and whose slide pin 20 is pulled, the control bar 12 will move. This causes the lever 32 to pivot so that its free end 35 leaves the path of motion of the second scanning lever 36. The lever, second lever 36 will then also move the slide lock 39 into release position, provided the amount of coins corresponding to the second lowest sales price is deposited in the collector 5. The first scanning lever is blocked by the bend of lever 31.

When the actuation of a merchandise dispensing device is started, both of whose slide pins 19 and 20 are pushed, then both control bars 11 and 12 are shifted and, accordingly, both levers 31 and 32 with the bends 42, 43 are pivoted out of the path of motion of all scanning levers 36. Then even the first scanning lever 36 coordinated with the lowest sales price can shift the slide lock 39, provided the amount in coins corresponding to the lowest sales price has reached the collector 5 (so that cam plate 37 is in proper position).

It is easy for the operating personnel to set the slide pins 19 and 20 by means of their heads 21 and 22 and because of the snap-in positions provided. If one of the merchandise dispensing devices is to be switched to another one of the sales prices provided, all that needs be done is reset the slide pins 19 and 20 of that particular merchandise dispensing device accordingly.

Due to the fact that the configuration of the position of the slide pins 19 and 20 relative to the bushings 13, 16 is immediately recognizable as to which pins are pushed and which pins are pulled, it is easy to find out which merchandise dispensing device is set to which sales price.

The following table is a compilation of the setting possibilities described:

| | Pin 19 | Pin 20 | Lever 31, 42 | Lever 32, 43 | Scanning lever 36 blocked |
|---|---|---|---|---|---|
| lowest | | | | | |
| 1st price | pushed | pushed | releases | releases | — |
| 2nd price | pushed | pulled | blocks | releases | 1st, 3rd |
| 3rd price | pulled | pushed | releases | blocks | 1st, 2nd |
| 4th price | pulled | pulled | blocks | blocks | 1st, 2nd, 3rd |
| highest | | | | | |

The selection of one of eight sales prices could be achieved by arranging three control bars and appropriate couplings.

It goes without saying that the setting mechanism is applicable also to cases in which the merchandise dispensing devices are disposed under storage chutes.

Numerous other embodiments fall into the scope of the invention. In particular, the invention is not restricted to being used in vending machines with a certain number of merchandise dispensing devices. Also, a single control bar only may be provided. Then, however, the merchandise dispensing devices can be set only to one of two sales prices each.

While a specific embodiment of the invention has been shown and described in detail to illustrate the application of the principles of the invention, it will be understood that the invention may be embodied otherwise without departing from such principles.

What is claimed is:

1. A price setting mechanism for a vending machine, to set one of two or more sales prices for merchandise dispensing devices which are mounted on an operating base plate and along which extends at least one control bar coupled to at least one respective merchandise dispensing device by means of coupling members, and to a release mechanism for the merchandise dispensing devices, the price setting mechanism comprising:

a guide bushing connected to said at least one control bar which extends transversely to a travel direction of said control bar;

a slide pin slidably mounted in said bushing; and pin hold means for holding said pin in one of two positions with an end of said pin projecting into the path of motion of a control cam of the one merchandise dispensing device and the other position with said end outside of the path of motion of the control cam;

another end of said slide pin projects beyond said bushing in each one of said two positions on an operating slide of said base plate, opposite the merchandise dispensing devices.

2. A setting mechanism according to claim 1, wherein said slide pin has a handle head on the operating base plate side opposite the merchandise dispensing devices.

3. A setting device according to claim 1, wherein said bushing has a slot formed therein, said pin having fillets thereon, and a spring extending through said slot and engaged over one of said fillets form said hold means.

4. A setting device according to claim 3, wherein to provide two detent positions for the slide pin without intermediate positions, the fillets meet each other at an acute angle and at a bevel and have steep stop edges bounding said fillets.

5. A setting device according to claim 1, wherein each control bar is acted upon by a lever which blocks or releases scanning levers of a crediting unit as a function of the position of the slide pin whenever a merchandise dispensing device is actuated.

* * * * *